United States Patent [19]

Quigg

[11] 4,430,575

[45] Feb. 7, 1984

[54] TURBINE TURNING GEAR WITH HYDRAULIC OVERSPEED DRIVE

[75] Inventor: Allen B. Quigg, Schenectady, N.Y.

[73] Assignee: General Electric Company, Schenectady, N.Y.

[21] Appl. No.: 363,537

[22] Filed: Mar. 30, 1982

[51] Int. Cl.[3] ..... F16H 35/00; F16H 57/00

[52] U.S. Cl. ..... 290/52; 290/38 R; 290/48; 74/384; 74/405; 60/39.142; 60/709

[58] Field of Search ..... 290/52, DIG. 1, 38 R, 290/38 C, 2, 48; 415/175; 416/170 A; 74/384, 405; 60/39.08, 39.09 R, 39.14 M, 709, 39.142

[56] References Cited

U.S. PATENT DOCUMENTS

| | | | |
|---|---|---|---|
| 2,711,071 | 6/1955 | Frankel | 60/39.142 |
| 2,751,749 | 6/1956 | Newcomb | 60/39.142 X |
| 2,839,893 | 6/1958 | Rothemund | 60/39.142 |
| 2,942,415 | 6/1960 | Bayard | 60/39.142 |
| 2,959,919 | 11/1960 | Chiera et al. | 60/39.142 |
| 2,962,597 | 11/1960 | Evans | 60/39.142 X |
| 2,962,859 | 12/1960 | Hodgson et al. | 60/39.142 |
| 2,968,914 | 1/1961 | Birmann | 60/39.142 X |
| 2,972,911 | 2/1961 | Volk, Jr. et al. | 60/39.142 X |
| 2,984,976 | 5/1961 | Volk, Jr. | 60/39.142 |
| 3,156,229 | 11/1964 | Manning | 60/39.142 X |
| 3,157,993 | 11/1964 | Düttmann | 60/39.142 |
| 3,470,691 | 10/1969 | Smith | 60/39.142 X |
| 3,472,024 | 10/1969 | Strub et al. | 60/39.142 X |
| 3,485,041 | 12/1969 | Evans | 60/39.142 |
| 3,762,272 | 10/1973 | Esdobedo | 74/384 X |
| 3,835,722 | 9/1974 | Bertram et al. | 74/405 |
| 3,910,132 | 10/1975 | Elonen | 74/384 |
| 3,919,894 | 11/1975 | Keeter et al. | 74/384 |
| 4,041,792 | 8/1977 | Miller | 74/405 |
| 4,045,062 | 8/1977 | Disosway et al. | 290/38 R |
| 4,048,528 | 9/1977 | Whitney | 290/52 X |
| 4,077,748 | 3/1978 | Pötz | 290/52 X |
| 4,117,343 | 9/1978 | Hoffeins | 290/52 |
| 4,156,817 | 5/1979 | Preece et al. | 290/38 R |
| 4,170,211 | 10/1979 | Worthington | 290/38 R X |
| 4,194,414 | 3/1980 | Satoh et al. | 74/405 X |
| 4,211,070 | 7/1980 | Portmann | 60/39.08 |
| 4,319,495 | 3/1982 | Salicini | 74/405 |

FOREIGN PATENT DOCUMENTS

| | | | |
|---|---|---|---|
| 55-48005 | 5/1980 | Japan | 74/384 |
| 56-48105 | 5/1981 | Japan | 74/384 |

*Primary Examiner*—J. V. Truhe
*Assistant Examiner*—Terry Flower
*Attorney, Agent, or Firm*—John F. Ahern

[57] ABSTRACT

A turning gear arrangement for a turbomachine such as a large steam driven turbine-generator is disclosed. The turning gear arrangement includes a prime mover system which generates high starting torque for rolling the rotor of the turbine-generator over a narrow low speed range and which provides a lower, substantially constant torque over a wider high speed range. A preferred embodiment of the invention includes a drive gear mounted on the turbine motor shaft; a fixed gearing system through which drive torque is transmitted to the rotor shaft; and a prime mover having an electrical motor to provide high initial torque to start and maintain rotation of the turbine over a low speed range, and a hydraulic turbine providing lower, substantially constant torque to maintain rotation over a higher speed range.

16 Claims, 3 Drawing Figures

TURBINE TURNING GEAR WITH HYDRAULIC OVERSPEED DRIVE

BACKGROUND OF THE INVENTION

This invention relates generally to large turbomachines and in particular to turning gear arrangements for such machines.

Turning gear systems are used with large turbomachines, such as large steam turbine-generators, to cause slow rotation of the turbine rotor whenever the turbine is being started up, shutdown, or at such other times as it becomes necessary to jog the rotor into a different position. The slow rotation during startup and shutdown is carried out to ensure that the rotor remains straight since there is a tendency, particularly at high temperatures, for the rotor to sag between long bearing spans if left for too long in one position.

One example of a decoupling turning gear arrangement is that disclosed in U.S. Pat. No. 3,919,894 to Keeter et al, wherein the turning gear drives the turbine rotor through a bull gear attached to the rotor shaft. Whenever the turbine rotor is at an elevated speed (e.g., above the turning gear speed), the turning gear is automatically disengaged or decoupled from the rotor bull gear. A low speed signal is used to reengage the turning gear on shutdown as the rotor coasts down to zero speed. This is carried out by actuating a pressurized cylinder which moves a gear carriage and which thereby causes the gears to reengage. However, the turning gear may also be manually engaged. A feature of the Keeter el al arrangement is the inclusion of a small auxiliary electric motor in tandem with the large main motor to eliminate gear train backlash prior to rolling the turbine rotor with the larger motor. The Keeter et al patent, U.S. Pat. No. 3,919,894, is hereby incorporated herein by reference.

While turning gears as described above have generally proven to be highly reliable and effective for their purpose, there is a potential for premature disengagement of the turning gear from the turbine rotor on startup since the angular momentum of the rotor can carry it beyond the speed at which the turning gear is disengaged. If this occurs the rotor must then be allowed to coast back down for reengagement. Thus, there is the possibility of having to repeatedly stop and restart the rotor. Furthermore, as the rotor is brought up to turning gear speed from a dead stop or from essentially zero speed, there is a tendency for the rotor to oscillate about its final equilibrium speed. That is, the rotor speed initially overshoots then swings below the equilibrium speed. This is repeated for a number of cycles before the rotor finally settles down. Although the speed oscillations may last for only a few seconds, those of skill in the art have sought to provide apparatus which will effect a smoother startup while avoiding premature disengagement of the turning gear.

Accordingly, it is among the objects of the present invention to provide a turning gear arrangement which does not prematurely decouple from the rotor bull gear and with which final turning gear speed of the rotor is attained without undue oscillations in the rotor speed.

Other objects and advantages of the invention will appear from the ensuing description of the principles and operation of the invention and from the description of a preferred embodiment thereof.

SUMMARY OF THE INVENTION

For overcoming those problems outlined above, there is provided, according to the invention, a turning gear arrangement incorporating a prime mover system which generates high starting torque for rolling the turbine-generator rotor over a relatively narrow low speed range and which then provides a lower but substantially constant torque over a wider high speed range. A preferred turning gear arrangement according to the invention includes a drive gear affixed to the turbine rotor shaft; a fixed gearing system, a portion of which is selectively engagable with the shaft mounted drive gear for transmitting drive torque thereto; and a prime mover system including an electrical motor providing high initial torque to start and maintain rotation of the turbine over a lower speed range, and a hydraulic turbine providing lower, substantially constant torque to maintain rotation over a higher speed range contiguous to the lower speed range.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

Figure 1:
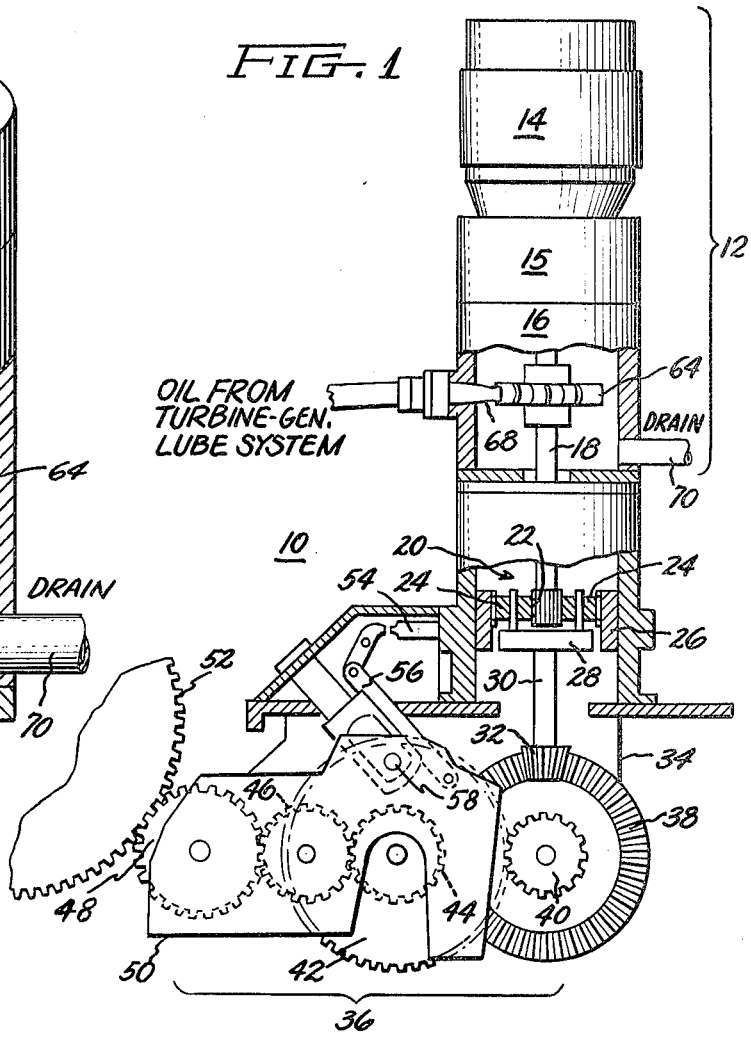
FIG. 1 is a partial cross sectional view of the turning gear and rotor drive gear according to the present invention.

With reference to FIG. 1, the turning gear 10 includes a prime mover system 12 comprising a main drive motor 14, a slip coupling 15, and a hydraulic drive turbine 16. The main drive motor 14 (preferably an electric motor) is mounted in series or in tandem with the slip coupling 15 and the hydraulic drive turbine 16 so that these components have a common output drive shaft 18. The output shaft 18 drives a planetary system 20 comprising a sun gear 22 and planet gears 24 mounted within a stationary ring or cage 26. The planet gears 24 drive a spline 28 which turns a drive shaft 30 having a bevel gear 32 affixed at its output end. The prime mover system 12, along with other operative components of turning gear 10, are mounted on a frame 34.

Bevel gear 32 drives a gear train 36 comprising reduction gear 38, coaxial pinion gear 40, second reduction gear 42, second coaxial gear 44, second pinion gear 46, and clash pinion 48. The clash pinion 48 is mounted on a movable carriage 50 which has an axis of rotation coincident with the axis of rotation of second pinion 46. The movement of carriage 50 allows clash pinion 48 to move in and out of engagement with the drive or bull gear 52 which is affixed to the central drive shaft (not specifically illustrated) of the turbine. Thus, the prime mover system 12 is able to impart slow rotary motion to the turbine rotor through a gearing system which includes an input portion for speed reduction and for intercoupling to the prime mover 12 and which includes an output portion selectively engagable with the drive gear 52 on the turbine drive shaft.

The movable carriage 50 is positioned into the engagement position by means of a pressurized fluid cylinder 54 and an associated linkage 56, the latter being attached to the movable carriage 50. The carriage 50 also includes a stop means 58 which is fixed to the turning gear frame 34. The pressurized fluid cylinder 54 may be actuated by a switch and solenoid valve combination (not shown). Once engaged, the clash pinon 48 and drive gear 52 remain engaged so long as the turning gear 10 is imparting drive torque to the turbine rotor. However, once the turbine rotor is running faster than it can be driven by the turning gear 10 (e.g., when powered by motive fluid or when the rotor angular momentum carries the rotor momentarily to such a speed), the forces on clash pinon 48 are reversed and the carriage 50 is tilted to a position which disengages pinon 48 and drive gear 52. The carriage 50 is slightly counterweighted to the disengaged position, so that when contact is lost between drive gear 52 and clash pinon 48, the carriage 50 will drop away and remain in the disengaged position until reset by again activating pressurized cylinder 54.

Figure 2:
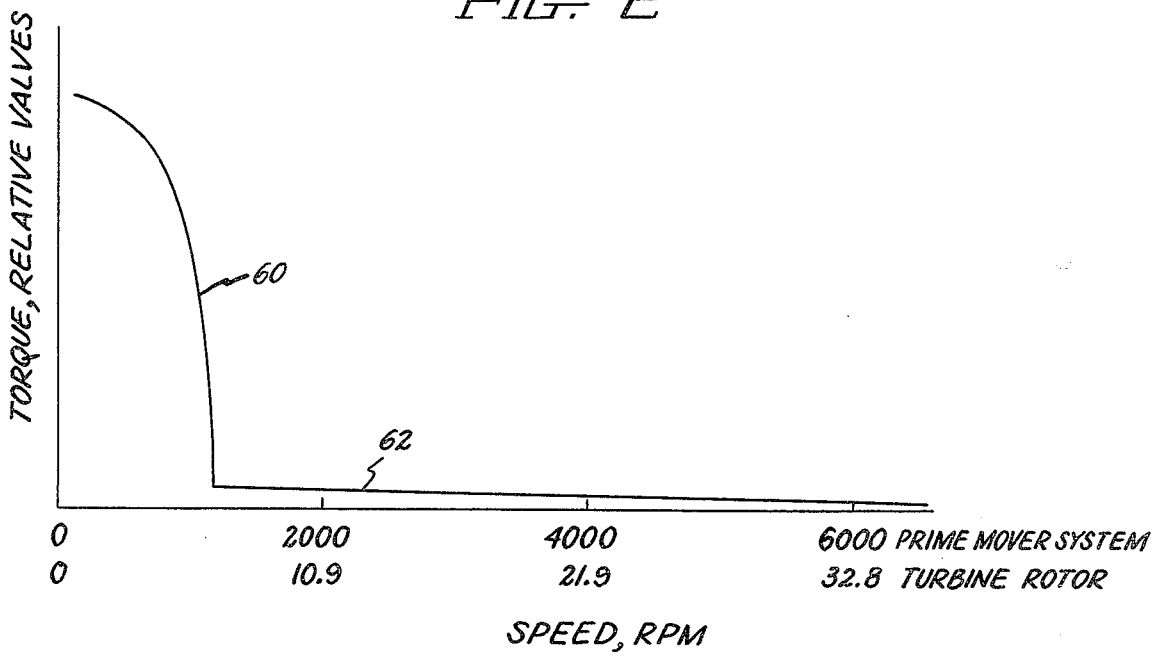
FIG. 2 is a curve illustrating the speed-torque characteristic developed by the prime mover system of the turning gear apparatus of FIG. 1.

To overcome problems of premature disengagement of the turning gear 10 from the drive gear 52 and to effect a smooth, non-oscillatory startup of the turbine rotor, prime mover system 12 provides drive torque according to the torque-speed characteristic curve of FIG. 2. Thus, torque is initially quite high in order to start the turbine-generator rotor and maintain rotation thereof over a lower speed range. Torque then declines rapidly to a lower level at which it becomes substantially constant over a much wider but higher speed range adjoining, or contiguous to, the lower speed range. A smoother startup of the turbine rotor results, during which engagement of the turning gear is maintained until the turbine is driven to relatively high speeds by the motive fluid.

The high initial torque of prime mover system 12 is supplied by electrical motor 14 which may, for example, be a two speed, three phase 900/1800 RPM, 40 HP motor. Motor 14 produces the first portion 60 of the torque-speed characteristic curve of FIG. 2. The lower, substantially constant second portion 62 of the torque-speed curve is produced by hydraulic drive turbine 16 which is tandemly coupled to motor 14 through shaft 18.

Figure 3:
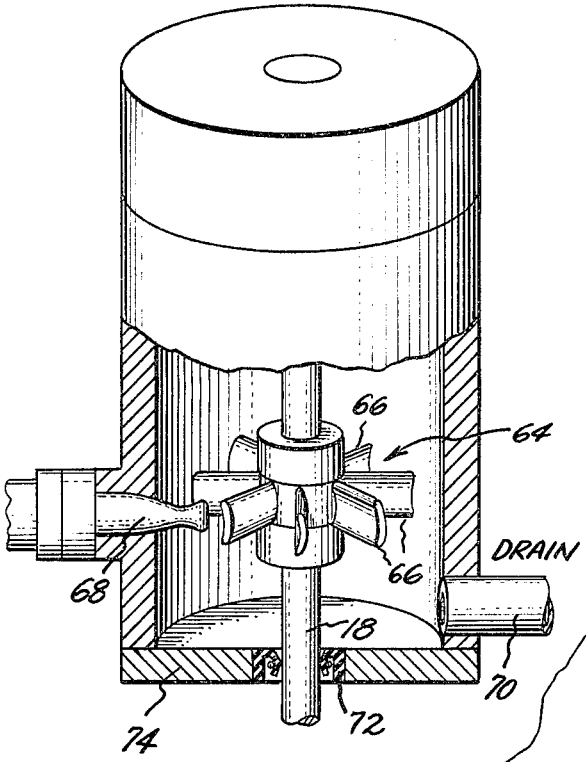
FIG. 3 is an enlarged view of the hydraulic drive turbine forming a portion of the turning gear apparatus of FIG. 1.

The hydraulic turbine 16 includes a turbine wheel 64 which has a plurality of curved blades 66 equally spaced about its outer circumference. The turbine wheel 64 is affixed to shaft 18. FIG. 3 illustrates the hydraulic drive turbine 16 in greater detail. The hydraulic turbine 16 is driven by a high pressure stream of hydraulic fluid supplied through a nozzle 68 and directed against the concave curvature side of each blade 66. The impinging hydraulic fluid imparts a drive torque to the wheel 64 and to the shaft 18. Spent hydraulic fluid is carried away from the hydraulic turbine 16 via a drain connection 70 and is prevented from leaking out around shaft 18 by rotary seal 72 at the point at which the shaft 18 passes through the turbine casing 74. A similar seal is provided at the top of the casing 74 although the upper seal is not illustrated in the drawings.

Preferably, the hydraulic fluid used for driving hydraulic turbine 16 is taken from the oil supply reservoir used for lubricating and cooling the bearings of the turbine generator for which the turning gear of the present invention is used. In such case, an auxiliary pump (not illustrated in the drawings) is utilized to supply the oil under pressure. In tests of the invention, using such oil, satisfactory results have been obtained by providing hydraulic turbine 16 with a wheel 64 having turbine blades 66 of about one and one-quarter inches long and one and one-half inches wide, and by injecting an oil stream through a nozzle of approximately 5/16" diameter at about 300 psig and at 40 gallons per minute. It will be recognized, however, as being generally within the skill of the art to devise other operating parameters for hydraulic turbine 16 which are suitable for the particular steam turbine-generator installation.

Interposed between the electric motor 14 and the hydraulic drive turbine 16 is an overrunning coupling 15 of conventional design. The overrunning coupling 15 functions to transmit torque in only one direction of rotation, i.e., in the normal forward rotational direction of motor 14. Thus, so long as the turning gear 10 is operating at or below the speed at which motor 14 drives the turbine, then torque from motor 14 is transferred to shaft 18. On the other hand, at higher speeds, generally along the segment 62 of the torque-speed characteristic curve of FIG. 2, there is no torque transfer from motor 14 to the shaft 18. Slip coupling 15 thus allows the hydraulic turbine 16 to drive the shaft 18 at speeds higher than the speed of motor 14. Notable, however, is that fact that slip coupling 15 may be eliminated while achieving the same effect by deenergizing the motor 14 at elevated speeds and allowing it to be freely driven by hydraulic drive turbine 16.

Operation of the invention is as follows. Upon startup of the turbine-generator, carriage 50 is brought to the engagement position by the action of linkage 56 and pressurized cylinder 54. The prime mover system 12 is then started by activating motor 14 and hydraulic drive turbine 16 substantially simultaneously. The hydraulic turbine 16 is activated by the application of high pressure oil through nozzle 68. Very high torque is initially applied by the motor 14 in order to get the turbine-generator rolling. However, it will be understood that the torque from the motor 14 and the hydraulic turbine 16 are additive. At higher speeds the motor torque declines essentially to zero while torque to sustain rotation and to maintain engagement of clash pinon 48 and drive gear 52 is provided by the hydraulic drive turbine 16. The result is that, although the turbine-generator rotor may be momentarily carried beyond its equilibrium turning gear speed, the turning gear 10 does not become prematurely disengaged from the drive gear 52 and oscillatory swings and rotor speed about the equilibrium speed are eliminated.

Thus while there has been shown and described what is considered a preferred embodiment of the present invention, it is understood that various other modifications may be made therein. For example, although the electric motor and hydraulic drive turbine included in the prime mover system are described and illustrated as being tandemly coupled to a common drive shaft, it will be apparent to those of ordinary skill in the art that other, non-tandemly coupled arrangements may be devised. It is intended to claim all such modifications which fall within the true spirit and scope of the present invention.

The invention claimed is:

1. Apparatus for smoothly starting and slowly rotating the rotor of a turbomachine, comprising:

a drive gear affixed to the turbomachine rotor;

a gearing system fixedly mounted with respect to said turbomachine rotor for transmitting torque to said drive gear to cause rotation of said rotor, said gearing system having an output gearing portion selectively engagable with said drive gear: and a prime mover system intercoupled to said gearing system to provide said torque thereto, said prime mover system providing torque at a higher initial value for starting rotation of said rotor and for maintaining rotation thereof over a lower speed range and providing torque at a lower, substantially constant value for maintaining rotation of said rotor over a higher speed range contiguous to said lower speed range.

2. The apparatus of claim 1 wherein said prime mover system includes an electric motor providing said higher initial value of torque and a hydraulic drive turbine providing said lower, substantially constant value of torque.

3. The apparatus of claim 2 wherein said electrical motor and said hydraulic turbine are substantially coaxial and tandemly connected to a common output drive shaft.

4. The apparatus of claim 3 further including an overrunning coupling interposed between the electrical motor and the hydraulic turbine so that the hydraulic turbine can run independently at speeds higher than the speed of the electrical motor.

5. The apparatus of claim 4 wherein said hydraulic turbine includes:

a turbine wheel having a plurality of radially projecting blades circumferentially spaced apart about the periphery of said wheel; and nozzle means for receiving hydraulic fluid under pressure and for directing a stream of said fluid to impinge upon the blades of said turbine wheel to provide said lower, substantially constant torque.

6. The apparatus of claim 5 wherein the hydraulic fluid for said hydraulic turbine is lubricating oil taken from an oil supply reservoir used for turbine-generator bearing lubrication and cooling.

7. Turning gear apparatus for slowly rotating a turbine-generator rotor through a central drive shaft, such apparatus comprising:

a drive gear affixed to the drive shaft for rotation therewith;

a gearing system mounted in fixed relationship to said drive shaft for transmitting torque from a prime mover system to said drive gear to cause rotation of said turbine-generator rotor, said gearing system having an output gearing portion selectively engagable with said drive gear and having an input gearing portion for intercoupling with said prime mover; and said prime mover system includes an electrical motor providing higher initial torque to start rotation of said rotor and to maintain rotation thereof over a lower speed range and a hydraulic turbine providing lower, substantially constant torque to maintain rotation of said rotor over a higher speed range contiguous to said lower speed range, said initial torque declining substantially to zero at an upper end of said lower speed range.

8. The apparatus of claim 7 wherein said electrical motor and said hydraulic turbine are substantially coaxial and tandemly coupled to a common output drive shaft.

9. The apparatus of claim 8 further including an overrunning coupling interposed between the electrical motor and the hydraulic turbine so that the hydraulic turbine can run independently at speeds higher than the speed of the electrical motor.

10. The apparatus of claim 9 wherein said hydraulic turbine includes a turbine wheel having a plurality of radially projecting blades circumferentially spaced apart about the periphery of said wheel and a nozzle means for receiving hydraulic fluid under pressure and for directing a stream of said fluid to impinge upon the blades of said turbine wheel to provide said lower, substantially constant torque.

11. The apparatus of claim 10 wherein the hydraulic fluid for said hydraulic turbine is lubricating oil drawn from an oil supply used for turbine-generator bearing lubrication and cooling.

12. A turning gear apparatus for rolling a turbomachine rotor by selectively engaging a drive gear on the rotor, said apparatus comprising:

a stationary frame mounted adjacent to the rotor drive gear;

a carriage pivotedly mounted to the frame;

a first pinon mounted on the carriage and pivotal therewith, for engaging the rotor drive gear;

a second pinon mounted on the frame and having an axis of rotation coaxial with the carriage axis of rotation, said second pinon being in continuous engagement with said first pinon;

means for selectively positioning the carriage so that the first pinon may engage the rotor drive gear;

a gear drive mounted on the frame and engaging the second pinon;

an electric motor mounted for rolling said rotor through said gear drive and said first and second pinons, said electric motor being adapted to impart relatively high torque to start said rotor and maintain rotational speed thereof over a lower range of speeds; and a hydraulic turbine mounted for rolling said rotor through said gear drive and said first and second pinons, said hydraulic turbine being adapted to impart lower, substantially constant torque to maintain said rotor rotation over a higher range of speeds, said higher and lower speed ranges being contiguous.

13. The turning gear apparatus of claim 12 wherein said electric motor and said hydraulic turbine are serially connected having a common output shaft driving said gear drive.

14. The turning gear apparatus of claim 13 further including an overrunning coupling intercoupling said electric motor and said hydraulic turbine, said overrunning coupling being operative to allow said hydraulic turbine to freely run at speeds higher than the speed of said electric motor.

15. The turning gear apparatus of claim 14 wherein said hydraulic turbine includes a turbine wheel having a plurality of radially projecting blades circumferentially spaced apart about the periphery of said wheel and nozzle means for receiving hydraulic fluid under pressure and for directing a stream of said hydraulic fluid to impinge upon the blades of said turbine wheel to provide said lower, substantially constant torque.

16. The turning gear apparatus of claim 15 wherein the hydraulic fluid for said hydraulic turbine is lubricating oil drawn from an oil supply used for lubricating and cooling bearings of the turbomachine.

* * * * *